US005652692A

United States Patent [19]

Barbieri

[11] Patent Number: 5,652,692

[45] Date of Patent: Jul. 29, 1997

[54] DEVICE TO REMOVE ELECTROSTATIC CHARGES IN EXCESS FROM A BODY

[76] Inventor: Girolamo Barbieri, Via Montello, 10-22069 Rovellasca (Como), Italy

[21] Appl. No.: 539,169

[22] Filed: Oct. 4, 1995

[30] Foreign Application Priority Data

Oct. 17, 1994 [IT] Italy ..... C094A0019

[51] Int. Cl.[6] ..... H05F 3/02

[52] U.S. Cl. ..... 361/220; 361/212; 361/235

[58] Field of Search ..... 361/212, 215, 361/220, 225–228, 235; 174/556, 6

[56] References Cited

U.S. PATENT DOCUMENTS 620,679 3/1899 Shyrock ..... 607/149

911,260 2/1909 Pennock ..... 307/149

2,943,242 6/1960 Schaschl ..... 361/212

3,048,498 8/1962 Juvinall et al. ..... 427/484

*Primary Examiner*—Fritz Fleming

*Attorney, Agent, or Firm*—Laff, Whitesel, Conte & Saret, Ltd.

[57] ABSTRACT

Removal of electrostatic charges from a body (3), in particular an article of manufacture submitted to electrostatic painting, is achieved by a device comprising an accumulation mass (2) made of lead and coupled with a copper drainage element (4), both having a ribbon-like structure and being rolled up in the form of a coil (5), upon interposition of an insulating layer (6) between the contiguous turns (5*a*). The drainage element (4) has an input terminal (7) disposed in the middle of the coil (5) and connected with the body (3), and an output terminal (8) disposed on the coil periphery and connected to the conventional grounding line (T).

15 Claims, 1 Drawing Sheet

DEVICE TO REMOVE ELECTROSTATIC CHARGES IN EXCESS FROM A BODY

BACKGROUND OF THE INVENTION

1. Field of the Invention

The present invention relates to a device to remove electrostatic charges from a body, of a type comprising at least one grounding conductor operatively interconnected between said body and a grounding line.

More particularly, in the embodiment to which reference is made in the progress of the present description, the device in question is especially conceived for use in electrostatic painting plants, in order to eliminate the electrostatic charges inevitably tending to store up in the articles being manufactured and/or in the different apparatus and structures forming said plants. However the principles proposed by the present invention can, after suitable adaptations if necessary, be validly utilized to remove electrostatic charges from machines or machine parts of other kinds, such as for example, photocopying machines, electric motors and the like, and/or on the occurrence of any other situation in which electrostatic charges stored in excess in a body are wished to be reduced or eliminated.

2. Prior Art

It is known that current plants for electrostatic painting of articles of manufacture essentially comprise booths or tunnels in which atomized paint is usually sprayed onto the article of manufacture by appropriate equipment usually consisting of suitable guns fed with a compressed air flow carrying the paint particles. Disposed close to the gun delivery nozzle is one or more electrodes creating an electric field adapted to electrostatically charge the paint particles so that they can be attracted by and adhere to the article.

A subsequent baking step causes polymerization of the paint and final adhesion of same to the article being manufactured.

It is pointed out however that electrostatic, magnetic, electromagnetic currents and/or currents of any other, and in any case undesired, nature produced for electrostatically charging the paint particles, adversely affect a correct painting process at the moment that the article of manufacture and/or given parts or fixtures in the painting plant are also electrostatically charged. In more detail, the presence of these electrostatic charges in excess can for example give rise to repulsion of the arriving paint particles by the electrostatically charged article, loss of the electrostatic charge induced in the paint particles while they are moving towards the article, and production, under particular circumstances, of electric discharges between the electrodes associated with the gun delivery nozzle.

Such problems bring about a bad operation of the plant in general, which will impair both the quality efficiency, in terms of evenness and homogeneity of the paint layer coated onto the article of manufacture, and the quantity efficiency intended as the ratio in percentage terms between the paint amount deposited onto the article and the paint amount delivered by the nozzle. In plants of normal conception the quantity yield in many cases does not exceed values in the range of 50–60%.

It is pointed out that the high percentage of dispersed material also has adverse effects on the sanitary work conditions and the environment in general, which makes it necessary to adopt many measures of expensive application in order to comply with the severe anti-pollution provisions regulating painting and similar activities involving the use of chemicals.

In addition, since paint encounters many difficulties in adhering to the article of manufacture due to the presence of electrostatic charges thereon, careful checks are necessary while painting is being carried out, and subsequent interventions are needed in order to retouch those parts of the article on which there was an insufficient amount of deposited paint, which will bring about a slowing down in the production cycle and an increase in the production costs.

In order to limit the problem resulting from the excessive presence of electrostatic charges, recent studies being the object of the European Patent application No. 0 572 358 have suggested to mix an additional fluid with the air delivered from the gun nozzle, in the presence of which fluid the effect of the electrostatic charge induced on the paint particles is increased so that said particles will adhere more strongly to the article of manufacture.

This expedient has brought to important improvements with reference to the painting efficiency and the working quality. However, all problems connected with an insufficient drawing off or "draining" of the electrostatic charges from the article of manufacture and/or the different plant parts remain substantially unchanged.

SUMMARY OF THE INVENTION

It is an object of the present invention to solve the problems of the known art by a device enabling electrostatic charges to be removed from a body in an undoubtedly more efficient manner than obtainable with a normal grounding. In particular, the inventive solution described by way of example aims at achieving an efficient elimination of the electrostatic charges from an article of manufacture and/or apparatus and/or other components of an electrostatic painting plant.

In accordance with the present invention, it has been found that an important improvement in the removal of the electrostatic charges present in a body and/or environment is achieved by associating with a conventional grounding line, an accumulation mass of metal material of a specific weight greater than that of the material forming the body from which the electrostatic charge is wished to be removed, combined with a drawing-off or "drainage" element of a material having an electic conductivity greater than that of the accumulation mass.

In greater detail, the invention pertains to a device to remove the electrostatic charges in excess from a body, comprising at least one accumulation mass made of a metal material having a specific weight greater than that of said body; at least one drainage element made of a metal material having an electric conductivity greater than that of the material forming the accumulation mass, said drainage element being arranged in contact relationship with the accumulation mass itself and being provided, at respectively opposite sides, with an input terminal and an output terminal operatively connected with said body and said grounding conductor, respectively.

BRIEF DESCRIPTION OF THE DRAWINGS

Further features and advantages will be more fully understood from the detailed description of a preferred non-exclusive embodiment of a device to remove electrostatic charges from a body according to the present invention. This description is taken hereinafter by way of non-limiting example with reference to the accompanying drawings, in which.

DESCRIPTION OF THE PREFERRED EMBODIMENT

With reference to the drawings, a device to remove the electrostatic charges in excess from a body according to the present invention has been generally identified by 1.

The device 1 essentially comprises an accumulation mass 2 preferably made of lead or a material or metal alloy of a specific weight greater than that of the material forming the body 3 from which the electrostatic charges in excess are to be removed. In the example herein described the body 3, diagrammatically shown in FIG. 2, consists of an article of manufacture usually of metal material, submitted to an electrostatic painting process, and/or an apparatus or another structure being part of the painting plant in which the article of manufacture is processed.

The accumulation mass 2 is coupled with at least one drainage element 4 preferably made of copper material or at all events of a material or metal alloy of a greater electric conductivity and lower specific weight than the material forming the accumulation mass 2.

Figure 1:
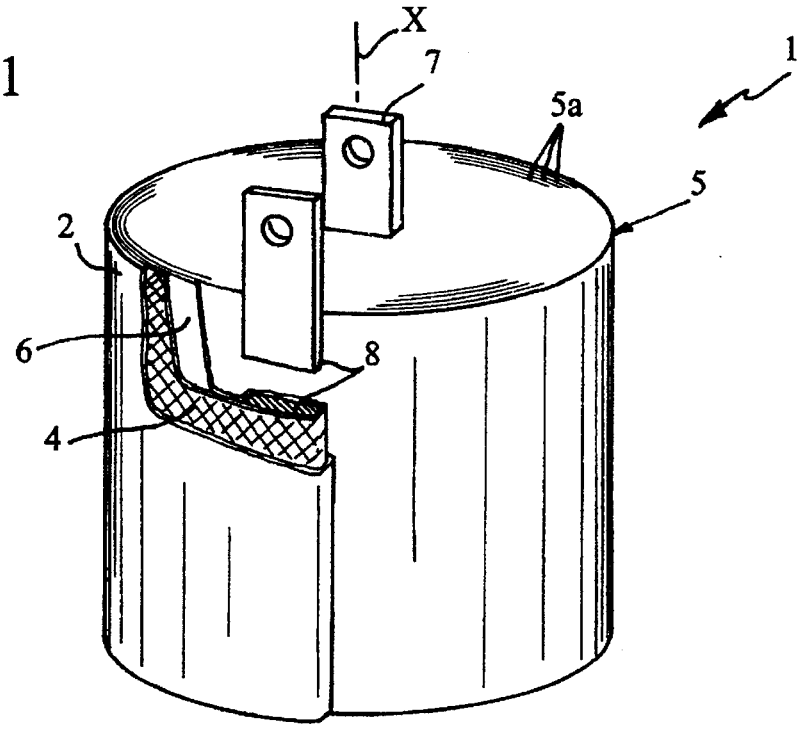
FIG. 1 is a partly cut away, perspective view of a device according to the present invention.

In greater detail, as clearly shown in FIG. 1, both the accumulation mass 2 and the drainage element 4 are made in the form of a plate, strip or thin ribbon, each defining at respectively opposite parts, an exchange side 2*a*, 4*a* and a separation side 2*b*, 4*b*. In addition, the accumulation mass 2 and drainage element 4 are mutually coupled in surface contact relationship over the whole extension of the respective, mutually facing, exchange sides 2*a*, 4*a* and are rolled up according to a common rolling axis "X" to form a cylindrical, conical or differently shaped coil defined by a plurality of consecutive turns 5*a* only partly shown in FIG. 1. The separation sides 2*b*, 4*b* are maintained spaced apart, each from the respectively adjacent turn 5*a*, preferably by interposition of at least one insulating layer 6 of an electrically insulating material. The insulating layer 6, a paper layer for example, is made to cover the separation side 2*b* of the accumulation mass 2 or, alternatively, the separation side 4*b* of the drainage element 4, before or while they are being spirally wound about axis "X", so that, when winding is over, the insulating layer 6 is interposed between the separation sides 2*b*, 4*b* of the accumulation mass 2 and the drainage element 4 belonging to respectively consecutive turns 5*a*.

In a preferential solution, the drainage element 4 has a net-like structure, so that an important amount of material can be saved while enabling a great surface extension to be in contact with the accumulation mass 2.

Figure 2:
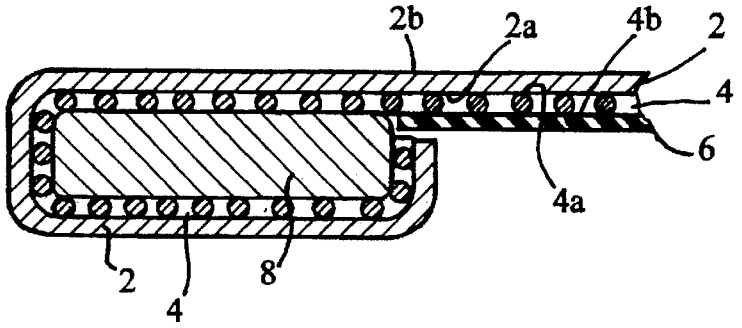
FIG. 2 is an enlarged sectional view illustrating a detail of the device shown in FIG. 1.

The drainage element 4 also has, at respectively opposite sides, at least one input terminal 7 preferably located at a centre position relative to the coil 5 and operatively connected with the body 2 from which the electrostatic charges are wished to be removed, and at least one output terminal 8 disposed peripherally on the coil 5 and leading off to a connection conductor 9 usually connected to a grounding line "T", shown by way of example in FIG. 2.

Preferably, the input terminal 7 and output terminal 8 substantially consist of metal bars, copper bars for example, fastened to the respective opposite ends of the drainage element 4 and laterally projecting therefrom, so as to facilitate connection of the device 1 between the body 2 and the grounding line "T".

As viewed from FIG. 2, each of said bars 7, 8 is connected in intimate contact relationship with the drainage element 4 by winding said drainage element around the bar itself in one or more turns.

Connection between the input terminal 7 and the body 3 can be achieved by an auxiliary connecting conductor 10 or by air, by means of one or more antenna elements or other appropriate means not shown in the figure.

Figure 3:
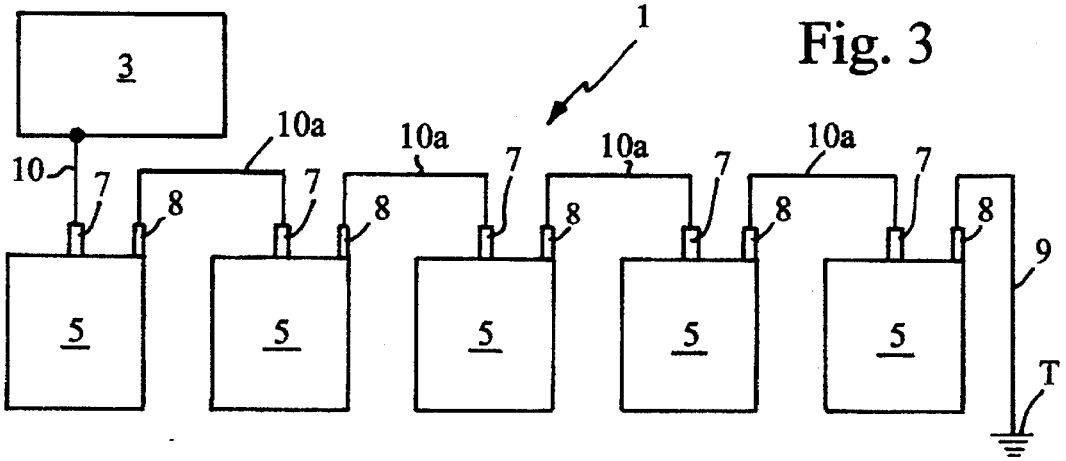
FIG. 3 diagrammatically shows an applicative example of the device in reference between a painting plant and a grounding line, the device being made up of a plurality of accumulation masses associated with respective drainage elements.

Under given situations, in order to achieve a more efficient removal of the electrostatic charges, the interposition of two or more coils 5 consecutively connected in series or in parallel may appear to be advantageous. In more detail, as clearly shown in FIG. 3, in this solution it is provided that, for one or more coils 5, the drainage element 4 combined with the accumulation mass 2 be connected to the input terminal 7 belonging the the next adjacent coil 5, for example by an auxiliary cable 10*a*.

The present invention achieves the intended purposes.

The use of the device in reference in electrostatic painting plants has actually given excellent results with reference to the painting efficiency and the features of homogeneity and thickness evenness of the paint layer applied to the articles of manufacture, which results have proved to be quite better than those usually obtainable in merely grounded painting plants.

Still more surprising results have been achieved when utilizing the device in question in combination with an air-enriching system as described in the above mentioned European Patent Application No. 0 572 358, which by itself leads to an advantageous increase in the effects of the electrostatic charge induced on the paint particles coming out of the gun.

It is understood that while the innovatory concepts suggested by the present invention have been described with particular reference for application to electrostatic painting plants, they can validly apply in other fields too, being subjected to appropriate adaptations, if necessary.

I claim:

1. A device to remove electrostatic charges in excess from a body of the type comprising at least one grounding conductor (9) operatively interconnected between said body (3) and a grounding line ("T"), further comprising:

at least one accumulation mass (2) made of a metal material having a specific weight greater than that of said body (3);

at least one drainage element (4) made of a metal material having an electric conductivity greater than that of the material forming the accumulation mass (2), said drainage element (4) being arranged in contact relationship with the accumulation mass itself and being provided, at respectively opposite sides, with an input terminal (7) and an output terminal (8) operatively connected with said body (3) and said grounding conductor (9), respectively.

2. The device as claimed in claim 1, wherein said accumulation mass (2) and drainage element (4) are each made in the form of a thin ribbon.

3. The device as claimed in claim 2, wherein said accumulation mass (2) and drainage element (4) mutually match at respectively mutually facing exchange sides (2*a*, 4*a*) and are rolled up in the form of a coil (5) in a plurality of consecutive turns (5*a*), each of said accumulation mass (2) and drainage element (4) having, at opposite parts from the exchange sides (2*a*, 4*a*), respective separation sides (2*b*, 4*b*) each spaced apart from the respectively adjacent turn (5*a*).

4. The device as claimed in claim 3, further comprising at least one insulation layer (6) interposed between the separation sides (2*b*, 4*b*) of the accumulation mass (2) and the drainage element (4) belonging to respectively consecutive turns (5*a*).

5. The device as claimed in claim 4, wherein said insulating layer (6) is made of paper material.

6. The device as claimed in claim 2, wherein said drainage element (4) has a net-like structure.

7. The device as claimed in claim 1, wherein said input terminal (7) and output terminal (8) are disposed in the middle and on the periphery of said coil (5), respectively.

8. The device as claimed in claim 1, wherein said drainage element (4) has a lower specific weight than the material forming the accumulation mass (2).

9. The device as claimed in claim 1, wherein the accumulation mass (2) is made of lead.

10. The device as claimed in claim 1, wherein the drainage element (4) is made of copper.

11. The device as claimed in claim 1, wherein the input terminal (7) of the drainage element (4) is connected to said body (3) by an auxiliary connecting conductor (10).

12. The device as claimed in claim 1, comprising at least two of said accumulation masses (2) provided with respective drainage elements (4) and connected consecutively in series, the output terminal (8) of the drainage element (4) of one of said accumulation masses (2) being connected with the input terminal (7) of the drainage element (4) belonging to the next adjacent accumulation mass.

13. The device as claimed in claim 1, wherein said input terminal (7) and output terminal (8) substantially consist of metal bars fastened to the respective opposite ends of the drainage element (4) and laterally projecting from the latter.

14. The device as claimed in claim 1, wherein said body (3) comprises at least one article of manufacture submitted to an electrostatic painting process in a respective painting plant.

15. The device as claimed in claim 1, wherein said body (3) is part of an electrostatic painting plant.

* * * * *